United States Patent [19]

Drake

[11] Patent Number: 4,508,342

[45] Date of Patent: Apr. 2, 1985

[54] GOLF PUTTER

[76] Inventor: Robert C. Drake, 37971 Huron Point Dr., Mt. Clemens, Mich. 48043

[21] Appl. No.: 479,564

[22] Filed: Mar. 28, 1983

[51] Int. Cl.[3] ..... A63B 53/02; A63B 53/14

[52] U.S. Cl. ..... 273/80 C; 273/168; 273/167 C; 273/80.2; 273/81.4

[58] Field of Search ..... 273/80 C, 167 C, 175, 273/80.2-80.9, 168, 167 R, 167 A, 167 B, 167 D-167 K, 171, 81.3; D21/217, 218, 219

[56] References Cited

U.S. PATENT DOCUMENTS

| | | | |
|---|---|---|---|
| D. 213,838 | 4/1969 | McAllister | 273/80 C |
| 1,201,728 | 10/1916 | Henry et al. | 273/81.3 |
| 1,616,377 | 2/1927 | Knight | 273/81.3 |
| 3,815,910 | 6/1974 | Raines | 273/80 C |
| 4,138,117 | 2/1979 | Dalton | 273/80 C X |

FOREIGN PATENT DOCUMENTS

| | | | |
|---|---|---|---|
| 1129313 | 10/1968 | United Kingdom | 273/80 C |
| 1232651 | 5/1971 | United Kingdom | 273/80.2 |

*Primary Examiner*—George J. Marlo

*Attorney, Agent, or Firm*—Barnes, Kisselle, Raisch, Choate, Whittemore & Hulbert

[57] ABSTRACT

A golf putter having an elongate head connected to a shaft. The shaft has a shank with a handgrip adjacent its upper end, an offset portion connected to the lower end of the shank and extending generally transversely thereof, and a depending portion projecting from the other end of the offset portion and connected to the head. The depending portion is connected to the head at a point which is adjacent the longitudinal center of the head and preferably transversely between the longitudinal centerline and the back of the head. Preferably the offset portion is inclined upwardly from the depending portion with respect to the longitudinal axis of the head and toward the front of the head at an angle of 10°-30° relative to the longitudinal axis of the head. Preferably the upper portion of the handgrip is inclined with respect to the shank toward the player and the ball striking face of the head.

16 Claims, 12 Drawing Figures

GOLF PUTTER

This invention relates to golf clubs and more particularly to a golf putter.

In an effort to improve the putting performance of golfers, prior golf club putters have been provided with a variety of head and shaft constructions and arrangements. One such putter has an elongate cylindrical head with a conventional staight shaft attached to the head at its inboard end and in alignment with the longitudinal axis of the head. Many putter constructions and arrangements either do not comply with or require the player to assume a stance when putting which does not comply with the rules of the United States Golf Association (USGA). Hence, such putters cannot be used in tournaments conducted pursuant to or sponsored or sanctioned by the USGA.

A putter embodying the invention has an elongated head and a shaft having a shank and an offset portion adjacent its lower end which is connected to the elongated head at a point immediately adjacent the center longitudinally or axially of the head between the opposed ends thereof. Preferably the point at which the offset portion of the shaft is connected to the head is also offset transversely from the longitudinal axis of the head so that it lies between this axis and the back of the head. Preferably with respect to the longitudinal axis of the head, the offset portion of the shaft slopes upwardly from its point of connection with the head and is inclined toward the front face of the head. Preferably the longitudinal axis of the upper portion of a handgrip on the shank is inclined to the axis of the shank and the front face of the head.

Objects, features and advantages of this invention are to provide a golf club putter which complies with the rules of the USGA, provides a player with an improved view of the ball and head when putting and an improved balance and feel of the club, compensates for an arcuate swing so that when the head strikes the ball it is at a right angle to the desired path of travel of the ball, compensates for the tendency of the ball to hook or slice from its desired path of travel if struck by the front face of the head when it is at other than a right angle to the desired path of travel of the ball, places the hands and forearm of a player closer to a natural position to thereby improve the swing of the putter and performance of the player, can be made with exactly the same parts for either a left-hand or right-hand player, and is rugged, durable and of economical manufacture and assembly.

These and other objects, features and advantages of this invention with be apparent from the following detailed description, appended claims, and accompanying drawings in which:

Figure 3:
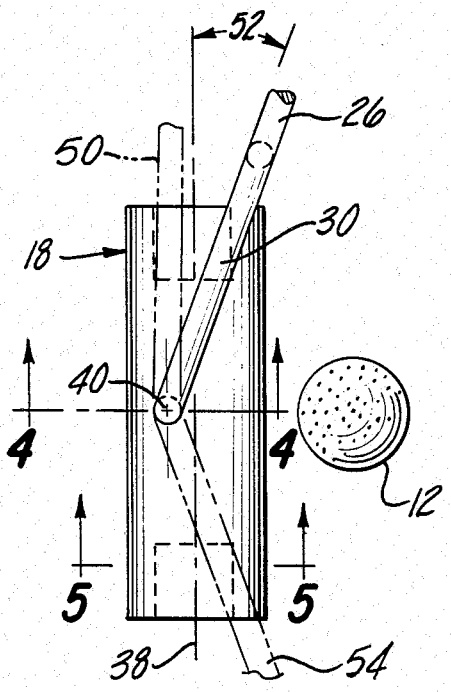
FIG. 3 is an enlarged fragmentary top view of the putter of FIG. 1.
Figure 4:
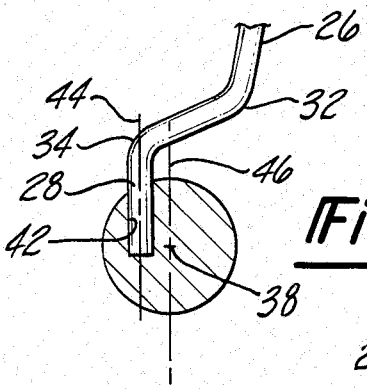
Figure 5:
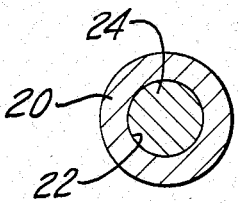
Figure 6:
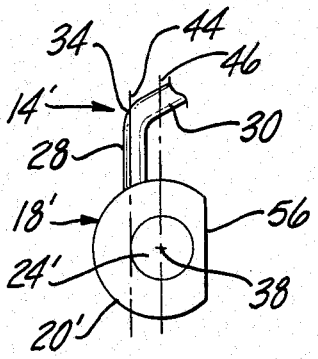
Figure 7:
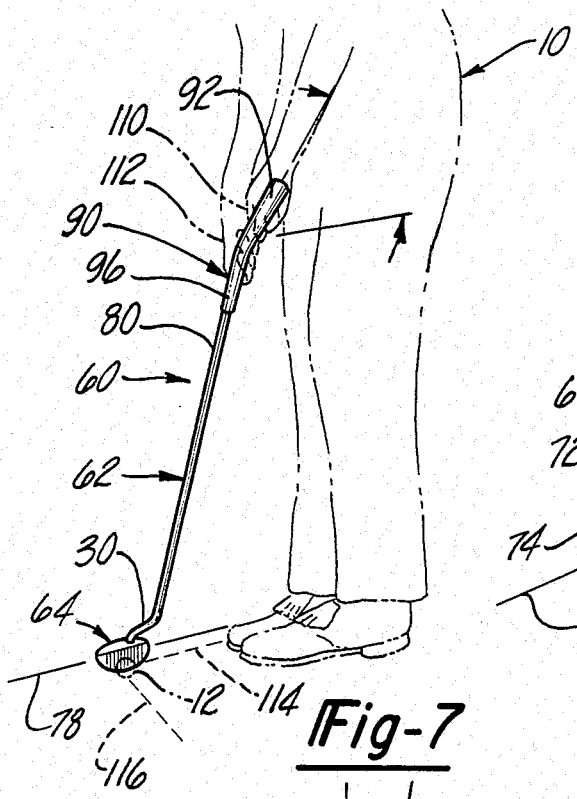
Figure 8:
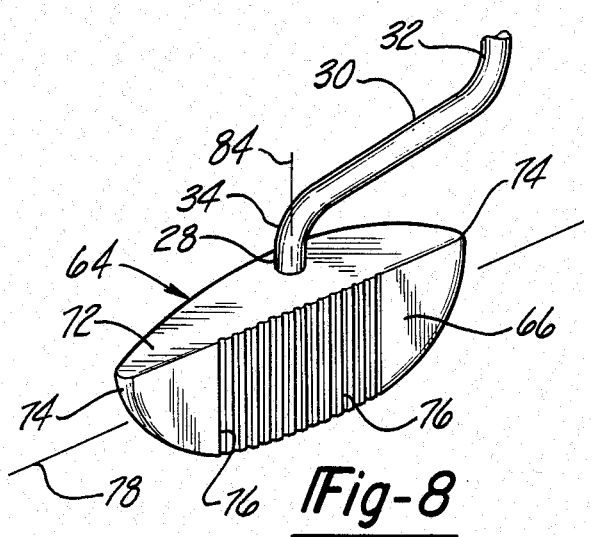
Figure 9:
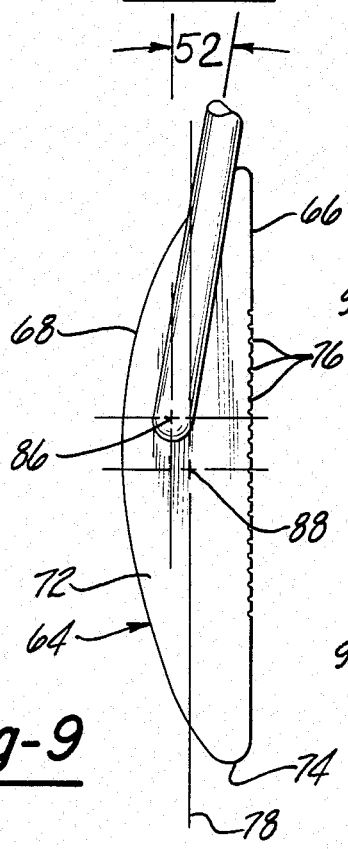
Figure 10:
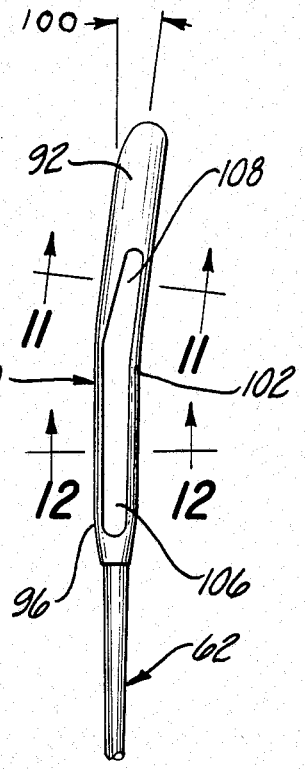
Figure 10:
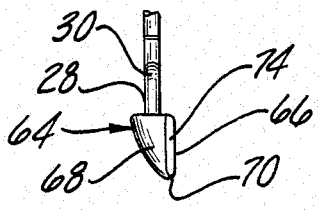

FIGS. 4 and 5 are sectional views on lines 4—4, and 5—5 respectively of FIG. 3;

FIG. 6 is a fragmentary end view of a putter embodying this invention having a modified head;

FIG. 7 is a fragmentary perspective view of a right-hand player addressing a golf ball with a modified form of a putter embodying this invention;

FIG. 8 is an enlarged perspective view of the head and the lower portion of the shaft of the modified putter of FIG. 7;

FIG. 9 is an enlarged fragmentary top view of the modified putter of FIG. 7;

FIG. 10 is a fragmentary side view of the modified putter of FIG. 7; and

Figure 11:
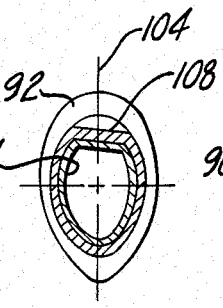
Figure 12:
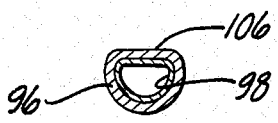

FIGS. 11 and 12 are sectional views on lines 11—11, 12—12 respectively of FIG. 10.

DETAILED DESCRIPTION

Figure 1:
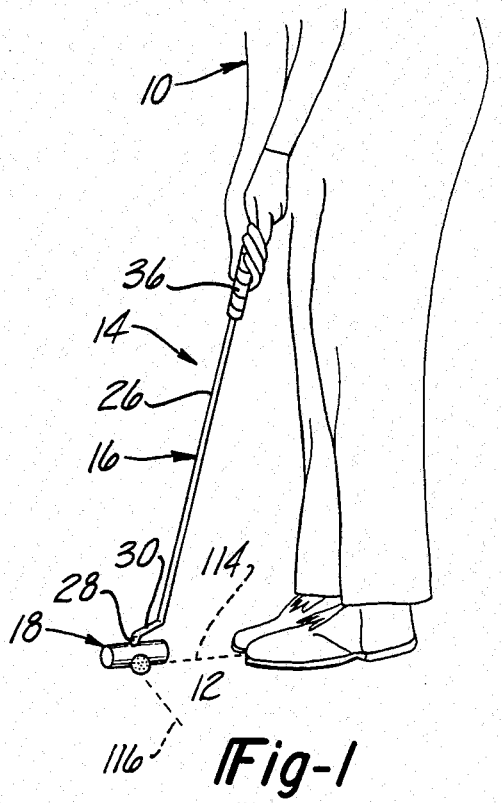
FIG. 1 is a fragmentary perspective view of a right-hand player addressing a golf ball with a putter embodying this invention.
Figure 2:
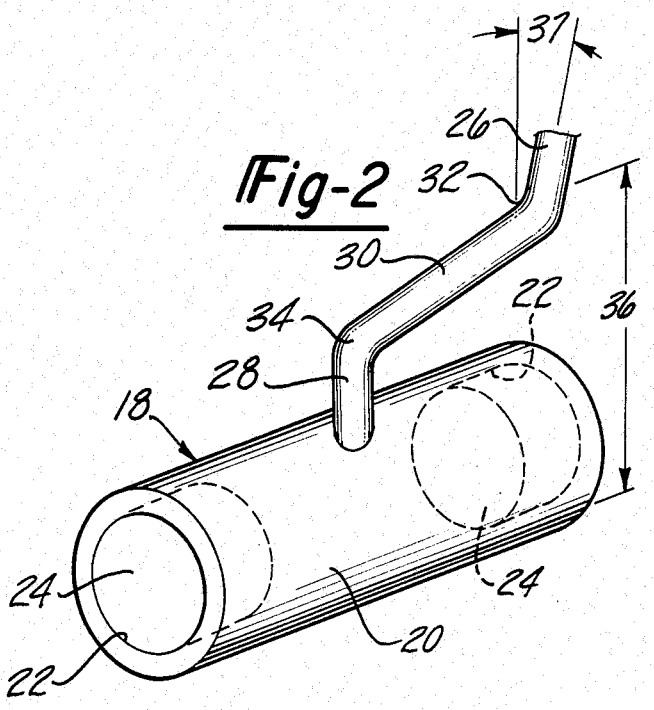
FIG. 2 is an enlarged perspective view of the head and the lower portion of the shaft of the putter of FIG. 1.

Referring in more detail to the drawings, FIG. 1 illustrates a right-handed player 10 addressing a golf ball 12 with a putter 14 embodying this invention having a shaft 16 and a head 18. So that the ball will begin to roll immediately when it is hit by the head 18, as shown in FIGS. 1 and 2, the front or ball contacting face of the head 18 is circular throughout. Compared to its vertical height, head 18 is horizontally or axially elongate.

Preferably head 18 has a solid and cylindrical body 20 of a material such as wood, plastic or metal such as stainless steel or aluminum. As shown in FIGS. 2, 3 and 5, body 20 has cylindrical pockets 22 in its opposed ends with weights 24 received therein. Weights 24 are of equal mass and preferably of a high density material such as lead. Head 18 has a diameter which is desirably in the range of about 1 to $1\frac{3}{4}$ inches and preferably about $1\frac{1}{4}$ to $1\frac{1}{2}$ inches, and a length which is desirably in a range of about 3 to $4\frac{1}{2}$ inches and preferably about $3\frac{1}{2}$ to 4 inches. Head 18 alone, including the weights 24, desirably weighs about 6–12 ounces and preferably about 8–10 ounces.

Shaft 16 has an elongate straight shank portion 26 and a depending head connecting portion 28 which in accordance with a feature of this invention are interconnected by an offset portion 30 and relatively sharp bends 32 and 34. A handgrip 36 is secured to the upper end of the shank 26. The length of the offset portion 30 is usually in the range of about $1\frac{1}{2}$ to 4 inches, desirably in the range of about $1\frac{3}{4}$ to $2\frac{3}{4}$ inches and preferably about 2 to $2\frac{1}{2}$ inches. Preferably the shaft 16 is a one-piece tube of tempered steel.

To comply with rules of the USGA the vertical distance 36 from the bottom of the head 18 to the top of the bend 32 in the shaft 16 should not be greater than five inches and the angle 37 between the axis of the shank 26 and a line at a right angle to the longitudinal axis 38 of the head 18 should be at least 10°. Preferably angle 37 is in the range of about 10° to 20°.

In accordance with another feature of this invention, the depending portion 28 of the shaft 16 is attached to the head 18 at a point 40 on the head which is longitudinally located desirably immediately adjacent to and preferably exactly in the center longitudinally of the head or longitudinally halfway between the ends of the head. As shown in FIG. 4, depending portion 28 of the shaft is received and fixed in a blind hole 42 in the body 20 which is located so that its axis 44 is parallel to a diameter or centerline 46 of the head.

In accordance with a further feature of this invention, and as shown in FIGS. 3 and 4, the point 40 at which the depending portion 28 of the shaft 16 is connected to the head 18 is preferably also transversely displaced or offset from the longitudinal axis 38 of the cylindrical body 20 of the head so that it lies between the longitudinal axis and the back face of the head. In other words, point 40 is also transversely offset from the axis 38 away from the front face or side of the head which contacts the ball 12. This transverse offset of point 40 from centerline 38 is usually in the range of about 1/16 to 154 of an inch, desirably in the range of about 1/16th to about 5/16ths of an inch and preferably about ⅛th to ¼th of an inch.

As shown in FIG. 3, although the offset portion 30 may extend essentially parallel to the centerline 38 of the head as indicated in phantom at 50, in accordance with a further feature of this invention preferably the offset portion 30 is inclined at an acute included angle 52 with respect to the longitudinal axis 38 toward the front face of the head which contacts the ball. The acute included angle 52 is usually in the range of about 10° to 30°, desirably in the range of about 15° to 25°, and preferably in the range of 15° to 20°.

In accordance with another feature of this invention, identical shafts 16 and heads 18 may be used to produce putters 14 for both left-handed and right-handed players. For right-handed players the shaft 16 is fixed to the head so that the offset portion 30 is in the position just described and shown in solid line in the drawings. For left-handed players shaft 16 is rotated so that the offset portion 30 extends toward the other end of the head 18 and the depending portion 28 is fixed to the head with the offset in the mirror image position shown in phantom at 54 in FIG. 3.

Preferably, although not necessarily, offset portion 30 slopes upwardly away from depending portion 28 at an acute included angle to the longitudinal axis 38 of the head which is usually in the range of about 5° to 20° and preferably about 10°.

FIG. 6 illustrates a putter 14′ having the same shaft 16 as the putter 14 and a modified head 18′ having a semi-cylindrical body 20′ with a flat forward face 56 for contacting the ball 12. Because of this flat forward face, the weights 24′ and the pockets therefor in the body 20′ have a smaller diameter. Such a putter 14′ having a flat forward face 56 is preferred by some players over the putter 14 having a circular or cylindrical forward face.

FIGS. 7–12 illustrate a right-hand modified putter 60 embodying this invention having a shaft 62 and a head 64 with an essentially flat or planar front or ball contacting face 66. To minimize the tendency of the front face of the head to be displaced from its desired path of travel if the head contacts the ground when the club is being swung by a player, the bottom, ends, and back face of the head are generally arcuate or rounded. Head 64 has a curved or generally semi-circular back face 68, arcuate bottom 70, a flat top face 72, and generally arcuate ends 74 which blend into the bottom 70 and the front and back faces.

In accordance with another feature of this invention, putter 60 compensates for the tendency of a ball to hook, slice or veer from its desired path of travel if struck by the front face of the head when it is skewed or at other than a right angle to the desired path of travel of the ball. This is achieved by providing a plurality of spaced apart grooves 76 in the front face 66 of the head which extend generally vertically or transversely to the longitudinal or generally horizontal axis 78 of the elongated head. Preferably grooves 76 are spaced about ⅛ of an inch apart on centers and each groove is about 1/16 of an inch wide and 1/16 of an inch deep.

In accordance with this invention, the shaft 60 has an elongate straight shank portion 80 and a depending head connecting portion 28 interconnected by an offset portion 30 and relatively sharp bends 32 and 34. The depending portion 28 is received and fixed in a blind hole in the head 64 with its axis 84 parallel to the front face 66 of the head and extending generally vertically or transversely to the longitudinal axis 78 of the head. As shown in FIG. 9, preferably the point 86 at which the depending portion 28 of the shaft 60 is connected to the head 64 is transversely displaced or offset from the longitudinal axis 78 of the head so that it lies between the longitudinal axis and the back face of the head. Preferably this point 86 also is offset generally longitudinally toward the player from the exact longitudinal center 88 of the head which is located longitudinally halfway between the ends of the head. Both the transverse offset and the longitudinal offset of this point 88 are usually in the range of about 1/16th to ⅜ of an inch, desirably in the range of about 1/16 to 5/16 of an inch preferably about ⅛ to ¼ to an inch.

In accordance with a further feature of this invention, putter 60 is constructed to place the hands of the player closer to a natural postion for grasping the shaft to thereby improve the swing of the golf club by the player and hence his putting performance. This is accomplished by the construction and arrangement of a handgrip 90 on the upper portion of the shaft 60. As shown in FIGS. 7 and 10–12 the upper portion 92 of the handgrip and the corresponding portion 94 of the shank 80 received therein are inclined with respect to the lower portion 96 of the handgrip and portion 98 of the shank received therein.

The upper portions 92 and 94 of the handgrip and the shank are inclined toward the player and preferably also toward the front face 66 of the head. As shown in FIG. 7, the upper portions 92 and 94 are inclined with respect to the longitudinal axis 78 of the head at an acute included angle desirably in the range of about 20° to 45° and preferably in the range of about 25° to 35°. The upper portions 92 and 94 also are inclined toward the front face of the head at an acute included angle 100 to a plane to the front face 66 of the head which is desirably in the range of about 10° to 30° and preferably in the range of about 10° to 20°.

To facilitate firmly holding the putter 60, the upper and lower portions 92 and 96 of the handgrip 90 and the corresponding portions of the shaft 60 are contoured to facilitate being firmly grasp by the forehand and backhand respectively of the player. As shown in FIGS. 10 and 11 inclined upper portion 92 of the grip and corresponding portion 94 of the shaft is tapered so that in cross section its perimeter or the distance around its periphery decreases as shown in FIG. 11 from the free end of the grip toward the bend 102 in the central portion of the grip. As shown in FIG. 11, preferably the upper portions are generally oval in cross section with their major axis 104 extending generally vertically. If desired, the lower portion 96 of the handgrip and the corresponding portion 98 of the shaft may also be tapered so that in cross section the distance around its periphery generally decreases from adjacent bend 102 toward the lower ends of these portions.

As shown in FIG. 12, in cross section the lower portions preferably have a bottom and sides with a generally semi-circular configuration although if desired it may be a continuation of the generally oval configuration of the upper portion 92 of the handgrip. To assure the handgrip 90 does not rotate in the hands of the player when he strikes the ball with the putter, a generally flat face 106 is provided in the top of the lower portion 96 of the handgrip and the corresponding portion of the shank. Preferably the upper portion 92 of the handgrip has a similar flat face 108 provided in the lower half of the upper portion 92 of the handgrip and its corresponding portion of the shaft. As shown in FIG. 7, a player grasping the putter typically places the thumb 110 and adjacent portion of the palm of his forehand on the flat face 106 or faces 106 and 108. Typically, some players also will place the thumb 112 of their backhand on the flat face 106 while other players will place this thumb on the back side of the lower portion 96 of the handgrip and the tips of at least some of the fingers of their backhand on the flat face 106. Of course, some players will develop differing and individualized positions of their digits and hands when grasping the handgrip.

In using putters 14, 14', and 60, a player usually assumes the normal stance in addressing the ball 12 used with conventional putters (as shown in FIGS. 1 and 7 for a right-handed player) and normally swings the putter in the conventional way to hit the ball. Due to the construction and arrangement of putters embodying this invention the player has an improved perspective on the ball which is believed to be achieved because, as indicated in FIGS. 1 and 7, he can position his feet and the handgrip 36 or 82 directly over a line 114 which passes through the center of the ball 12 and is at essentially a right angle to the intended path of travel 116 of the ball.

This invention also provides a putter which is believed to increase the likelihood that its head will strike the ball when the head is essentially at the bottom of its arcuate path of travel in a vertical plane and to provide compensation for the tendency of the player to move the head of the putter in a slightly arcuate path in a horizontal plane; all of which provides improved putting performance. Furthermore, the handgrip with an upper inclined portion of the putter 82 is believed to improve the swing of the putter by a player and the vertical grooves 76 in its head decrease the tendency of the ball to deviate from its desired path when the front face of the head is at other than a right angle to the desired path when it strikes the ball; all of which also improves putting performance.

I claim:

1. A putter golf club comprising a head constructed and arranged so that when oriented to hit a golf ball such head is elongated generally horizontally and the longitudinal axis of such head extends generally horizontally, a front face on said head for striking a golf ball, said front face extending substantially parallel to said longitudinal axis, a shaft having an elongate shank portion, an elongate offset portion extending generally transversely of and fixed to such shank portion adjacent the lower end of such shank portion, and a depending portion fixed to and extending from said offset portion at a point remote from the connection of said offset portion of said shank, said depending portion being generally transverse to the longitudinal axis and connected to said head at the top of said head at a point on said head intermediate the longitudinally elongate extent of said head, said head being fixed to said depending portion, and said elongate offset portion being inclined toward said front face at an acute included angle to said longitudinal axis of said head in the range of 10° to 30°.

2. The putter golf club of claim 1 wherein said front face for striking a golf ball in cross section is esentially an arc of a circle.

3. The putter golf club of claim 1 wherein said front face for striking a golf ball is essentially planar.

4. The putter golf club of claim 1 wherein said head is essentially semi-cylindrical and said front face for striking a golf ball is essentially planar.

5. The putter golf club of claim 1 wherein said point at which said depending portion of said shaft is connected to said head is also at a location offset generally transversely from the longitudinal axis of said head and lying between said longitudinal axis and a back portion of said head which is generally opposed to the front face of said head which strikes a golf ball.

6. The putter gold club of claim 5 wherein said transverse offset is in the range of 1/16th to ⅜th of an inch.

7. The putter golf club of claim 1 wherein said shank portion is inclined to the longitudinal axis of said head at an acute included angle not greater than about 80°.

8. The putter of claim 1 which also comprises a handgrip connected to said shank portion adjacent the upper end of such shank portion, said handgrip having a lower portion and an upper portion connected to and inclined at an obtuse included angle to such lower portion, and said upper portion of said handgrip is inclined to the longitudinal axis of said head at an acute included angle in the range of about 20° to 45°.

9. The putter golf club of claim 8 wherein said upper portion of said handgrip is inclined to said front face at an acute included angle in the range of about 10° to 30°.

10. The putter golf club of claim 8 which also comprises a generally flat upper face on said lower portion of said handgrip lying generally transverse to the longitudinal axis of said head.

11. The putter golf club of claim 8 wherein said upper portion of said handgrip is constructed and arranged such that it tapers such that the distance around the periphery of its cross section generally decreases from adjacent a free end thereof toward the other end thereof.

12. The putter golf club of claim 11 wherein said upper portion of said handgrip has a generally oval cross section with its major axis extending generally vertically.

13. The putter golf club of claim 1 which also comprises a handgrip connected to said shank portion adjacent the upper end of said shank portion, said handgrip having a lower portion and an upper portion connected to said lower portion, said upper portion being inclined toward the longitudinal axis of said head at an acute included angle in the range of about 20° to 45°, inclined toward the front face of said head which strikes a golf ball at an acute included angle in the range of about 10° to 30°, and inclined at an obtuse included angle to said lower portion of said handgrip.

14. The putter golf club of claim 13 which also comprises a generally flat upper face on said lower portion of said handgrip lying generally transverse to the longitudinal axis of said head.

15. The putter golf club of claim 13 wherein said elongate shank is inclined to the longitudinal axis of said head at an acute included angle of not greater than 80°.

16. The putter golf club of claim 1 wherein said depending portion of said shaft is fixed to said head immediately adjacent the center of the longitudinally elongate extent of said head.

* * * * *